United States Patent [19]

Carey

[11] Patent Number: 4,553,291

[45] Date of Patent: Nov. 19, 1985

[54] COLLAR FASTENER

[76] Inventor: Clarence W. Carey, 518 Cresta Vista La., Portola, Calif. 94025

[21] Appl. No.: 644,357

[22] Filed: Aug. 27, 1984

[51] Int. Cl.[4] ..... A41D 25/12

[52] U.S. Cl. ..... 24/55; 24/49 R; 24/49 TS; 24/60; 24/161

[58] Field of Search ..... 24/55, 56, 49 R, 49 CF, 24/49 CP, 49 P, 49 TS, 161, 561

[56] References Cited

U.S. PATENT DOCUMENTS

| | | | |
|---|---|---|---|
| 46,426 | 2/1865 | Snow | 24/60 |
| 270,173 | 1/1883 | Baldwin | 24/56 |
| 287,594 | 10/1883 | Vanderbilt | 24/60 |
| 294,869 | 3/1884 | Graves | 24/60 |
| 411,871 | 10/1889 | McCormick | 24/60 |
| 600,477 | 3/1898 | Congelton | 24/161 |
| 716,699 | 12/1902 | Franz | 24/56 |
| 766,408 | 8/1904 | Wooley | 24/60 |
| 1,465,848 | 8/1923 | Hopkins | 24/161 |
| 1,609,488 | 12/1926 | Merrill | 24/56 |
| 1,704,659 | 3/1929 | Dowd | 24/56 |

FOREIGN PATENT DOCUMENTS

| | | | |
|---|---|---|---|
| 352064 | 5/1905 | France | 24/60 |
| 617915 | 11/1926 | France | 24/56 |

*Primary Examiner*—Victor N. Sakran

*Attorney, Agent, or Firm*—Flehr, Hohbach, Test, Albritton & Herbert

[57] ABSTRACT

A collar fastener for bringing the two tapered sides of a shirt collar together wherein the fastener hooks into the under-surface or back surface of the collar on each side. The fastener fits unobtrusively under the necktie so as to make it substantially invisible to others. A spring disposed between the arms of the fastener serves to apply spring pressure.

1 Claim, 3 Drawing Figures

FIG_3
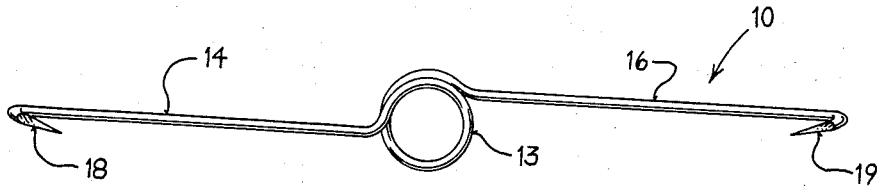
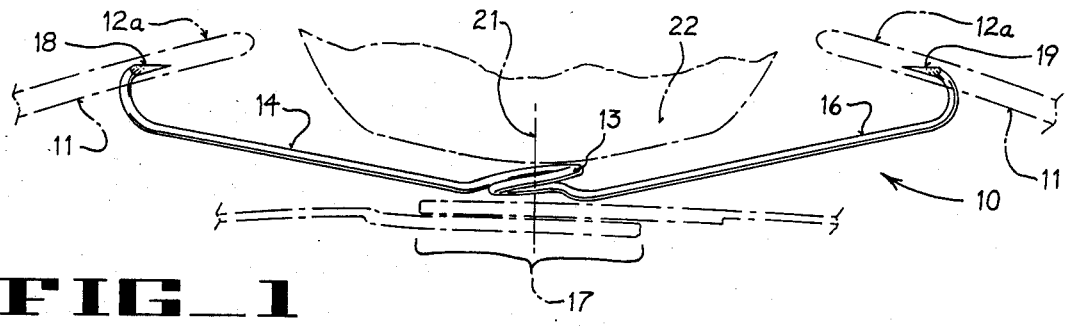
FIG_1
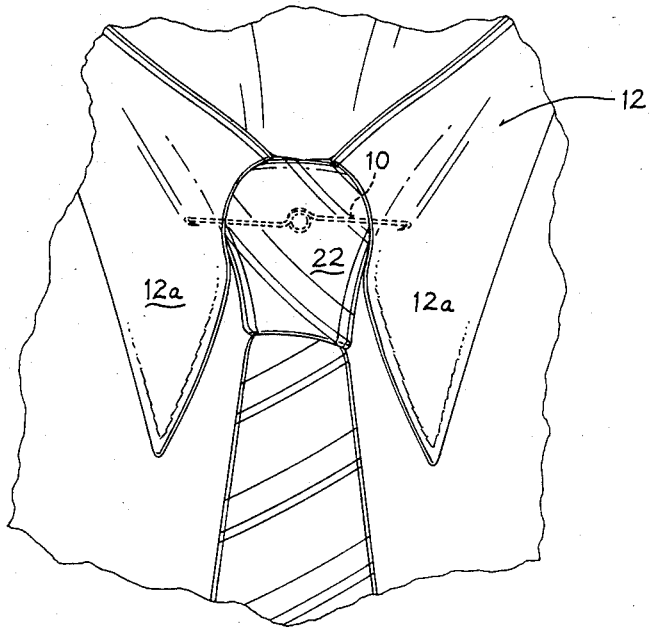
FIG_2

COLLAR FASTENER

This invention pertains to a collar fastener and more particularly to a simple and inexpensive device for yieldingly engaging the back surface of a shirt collar.

Collar fasteners which are generally used typically employ means which become visible when engaging collar tabs. As disclosed herein a collar fastener has been provided which lies under the necktie and which is completely unobtrusive when worn, and easily applied and removed without fraying or marking the exposed outer surface of the collar tabs.

SUMMARY OF THE INVENTION

In general there has been provided a collar fastener for engaging and drawing the tapered tab end portions of a shirt collar toward the shirt front to cause the end portions of the collar to be retained in such a position. The fastener includes a length of resilient wire formed to include a coiled spring portion intermediate the ends of the length of wire. The length of wire is divided into a pair of elongate arms forming an obtuse angle and adapted to extend forwardly from the spring portion (and the region of the collar button of the shirt) to cause the free end of each arm to engage the back surface of an associated end portion of the shirt collar. Means carried on the free end of each arm engages the back of an associated tapered tab end portion of the collar to draw the end portions together and toward the shirt front. This means lies in a plane substantially parallel to the axis of the coiled spring portion whereby a resilient force is applied to the collar to draw it backwardly toward the shirt front.

In general, it is an object of the invention to provide an improved collar fastener.

It is another object of the invention to provide an improved collar fastener which will remain unexposed on the wearer.

Yet another object of the invention is to provide a collar fastener which engages the back surface of the collar tabs in a manner not to fray the front or visible surface thereof.

The foregoing and other objects of the invention will become more readily evident from the following detailed description of a preferred embodiment when considered in conjunction with the drawings.

BRIEF DESCRIPTION OF THE DRAWING

FIG. 1 shows a plan view of a collar fastener according to the invention with phantom line portions representing portions of a collar as well as a necktie.

FIG. 2 shows a front elevation view of a collar held down using a collar fastener, shown in invisible lines, according to the invention; and FIG. 3 shows a front elevation view of a collar fastener according to the invention.

DETAILED DESCRIPTION OF A PREFERRED EMBODIMENT

Collar fastener 10 is designed to engage the under or back surface 11 of a collar 12 and to draw the two sides of the collar together. Each "side" of the collar can be defined as a tapered end portion 12*a*.

Fastener 10 includes a length of resilient wire, preferably made of 0.030 inch round stainless steel spring tempered wire with a maximum spread of two inches between the ends of fastener 10, in its passive state.

The length of wire is formed to include a coiled spring portion 13 intermediate the ends of the length of wire. Spring 13 divides the length of wire into a pair of elongate arms 14, 16 formed at a broad, obtuse angle causing the arms to extend forwardly from the spring 13 and the region 17 of a collar button of the shirt (not shown), to cause the free end of each arm 14, 16 to engage the back surface 11 of an associated end portion 12*a* of shirt collar 12.

The tips 18, 19 of arms 14, 16 respectively are formed as sharpened points. The sharpened points 18, 19 have been curled forwardly sufficiently to dispose the tips in substantially confronting relation to each other so as to permit tips 18, 19 to enter the back of the collar parallel to the front surface of the collar so as not to penetrate the front surface. In this manner the sharpened tips 18, 19 will penetrate only the back of the collar so as to inhibit any fraying from appearing on the front of the collar.

Spring 13 comprises a coiled portion of the length of wire used to make the collar fastener and as shown in FIG. 1, the imaginary axis 21 of spring 13 extends through the region 17 of the collar button and substantially parallel to an imaginary plane including the sharpened tips 18, 19 so as to prevent the tips from tending to penetrate the front surface of the collar.

From the foregoing it will be readily evident that there has been provided an improved collar fastener adapted to be disposed between the knot 22 of a necktie and the collar button region 17 of a collar. In addition, the sharpened tips 18, 19 of fastener 10 are capable of entering the back surface of a fabric collar while not protruding through the front surface. At the same time, the entry of the sharpened tips into the body of the collar from behind serves to draw the tapered collar portions together and toward the shirt front of the wearer to cause the end portions of the collar to be retained in that position.

I claim:

1. A collar fastener for engaging and yieldingly drawing the tapered end portions of a shirt collar toward the shirt front to cause the end portions of the collar to be retained in such position, said fastener comprising a length of resilient wire formed to include a coiled spring intermediate the ends of said length of wire, said length of wire being divided into a pair of elongate arms formed and adapted to be sprung forwardly as viewed in plan from said spring disposed in the region of the collar button of the shirt to cause the free end of each arm to engage the back surface of an associated end portion of the shirt collar, means carried on the free end of each said arm for engaging the back of an associated tapered end portion of the collar to draw the tapered end portions of the collar back toward the shirt front, said means including sharpened points formed on the tips of said arms, the ends of said arms being curled forwardly sufficiently to dispose said tips in substantially confronting relation to each other to permit said tips to enter the back of the collar parallel to the front surface of the collar whereby the tips penetrate only through the back of the collar, said tips lying in a plane substantially parallel to the axis of said coiled spring portion.

* * * * *